United States Patent [19]

Kidd, Jr. et al.

[11] 4,117,638

[45] Oct. 3, 1978

[54] SKYLIGHT FOR STANDING RIB METAL ROOFS

[75] Inventors: James M. Kidd, Jr., Smyrna; Jay G. Woods; Forest Park, both of Ga.

[73] Assignee: Atlanta Metal Products, Inc., Atlanta, Ga.

[21] Appl. No.: 854,544

[22] Filed: Nov. 25, 1977

[51] Int. Cl.[2] ..... E04D 13/03; E04B 7/18

[52] U.S. Cl. ..... 52/200; 52/395; 52/466

[58] Field of Search ..... 52/74, 75, 200, 395, 52/466, 468, 543, 582, 584, 586

[56] References Cited

U.S. PATENT DOCUMENTS

| | | | |
|---|---|---|---|
| 2,685,715 | 8/1954 | Helt | 52/75 X |
| 2,735,383 | 2/1956 | Gerbracht | 52/466 X |
| 2,790,400 | 4/1957 | Wasserman | 52/395 X |
| 3,550,335 | 12/1970 | Huffman | 52/200 |
| 3,886,676 | 6/1975 | Alfonso | 52/468 X |
| 3,982,373 | 9/1976 | Wilson et al. | 52/588 |
| 3,998,019 | 12/1976 | Reinwall | 52/478 |
| 4,009,548 | 3/1977 | Hicks | 52/466 X |

FOREIGN PATENT DOCUMENTS

| | | | |
|---|---|---|---|
| 1,259,585 | 3/1961 | France | 52/395 |
| 1,934,524 | 2/1973 | Fed. Rep. of Germany | 52/466 |
| 593,097 | 5/1959 | Italy | 52/200 |
| 188,008 | 3/1964 | Sweden | 52/200 |
| 431,002 | 8/1967 | Switzerland | 52/200 |
| 1,301,086 | 12/1972 | United Kingdom | 52/200 |
| 663,390 | 12/1951 | United Kingdom | 52/469 |

*Primary Examiner*—J. Karl Bell

*Attorney, Agent, or Firm*—Newton, Hopkins & Ormsby

[57] ABSTRACT

A skylight panel of fiberglass or other translucent material is integrated into a metal standing rib roof without loss of structural integrity in the roof system. The skylight panel is suspended in the roof system by a pair of formed suspension channels without the use of rivets or other like fasteners. The skylight panel is relieved of direct stresses caused by expansion and contraction of the roof system, and is protected from abrasion and wear caused by sliding contact with purlins or other metal parts. The skylight mounting means is characterized by simplicity and economy and is effectively sealed against leakage.

10 Claims, 6 Drawing Figures

SKYLIGHT FOR STANDING RIB METAL ROOFS

CROSS-REFERENCE TO RELATED APPLICATION

This application contains some subject matter in common with prior copending application Ser. No. 849,409, filed Nov. 7, 1977, for STANDING T-RIB ROOF SYSTEM.

BACKGROUND with THE INVENTION

As disclosed in the above-referenced application, metal standing rib roofs consist of multiple side-by-side panels of channel cross section. The standing webs of the roof panels are intervened by attaching clips whose feet are anchored to underlying purlins. A stand-off space suitable for receiving thermal insulation can be provided between the bottoms of the roof panels and the tops of the purlins. Cap strips are closed around top lateral flanges of the roof panels and superposed flanges of the attaching clips to complete the formation of standing T-ribs and to permanently join the roof panels in weather-tight relationship.

In the prior art, when it is desired to provide a skylight in roofs of this type, it has been customary to provide a translucent channel member formed of plastic or fiberglass and being of substantially the same width as the metal roof channels. Skylight suspension members in the form of metal angles are riveted to the side standing webs of the skylight panel and these angle members are then engaged with the panel attaching clips and cap strips in the usual manner to incorporate the skylight panel in the metal roof structure.

This customary construction presents serious problems which have not heretofore been solved in the prior art.

The differential in expansion and contraction between the metal roof panels and non-metal skylight panel is so great that the resulting pressures on the rivets can cause them to enlarge or distort the rivet holes and, in some cases, the riveted connections have actually torn or ruptured. This of course results in loss of roof integrity and strength and roof leakage.

In the prior art arrangements, the heavy stresses caused by normal roof expansion and contraction are applied directly to the skylight panel or panels which are incapable of withstanding the stresses, resulting in weakening the entire roof system. A metal roof must be able to expand and contract both laterally and longitudinally of the roof panels and as a result of this tremendous stresses are created and the materials employed must be able to withstand the stresses without failure or permanent deformation. The dissimilar materials involved providing a skylight renders it impossible for the structure to withstand the stresses without damage.

Another problem encountered in the prior art is that the non-metallic skylight panels readily abrade and wear due to frictional contact with underlying purlins or other metal parts of the roof system. As the roof expands and contracts, the purlins are subjected to limited rotation and such movements, even though small, can readily abrade and damage the translucent skylight panel formed of plastic or fiberglass.

The invention has as its objective to completely solve the above problems of the prior art by providing a skylight panel or panels for a standing rib metal roof whose use will not significantly lessen the structural integrity of the roof or create any tendency for the roof to leak as a result of having the skylight therein.

In accordance with the invention, all riveting of the skylight panel is eliminated and opposite sides of the skylight panel are supported by continuous metal channels or holders which interfit with the roof attaching clips and closable cap strips while suspending the non-metallic skylight panel in such a way that it is weather-tight and substantially relieved of heavy stresses due to roof expansion and contraction and is also supported out of contact with the purlins or other metallic parts of the roof system to thus avoid abrading the skylight panel. By means of the invention, it is necessary to form any holes whatsoever in the skylight panel and thus its inherent strength is unimpaired.

SUMMARY OF THE INVENTION

A unitary skylight panel of channel formation has sealant strips applied over the top longitudinal edges of its standing webs. Preformed side metallic suspension channels or holders are engaged over the side webs and sealant strips of the skylight panel and are then locked in permanently assembled relationship with the skylight panel so as to completely encompass opposite side portions thereof. The locked or closed skylight suspension channels are shaped and sized to interfit properly with the customary attaching clips of the roof system and the associated cap strips. The metal suspension channels for the skylight panel have flanges which guard the skylight panel against contact with metal parts likely to abrade or damage the same. The metal suspension channels are structurally organized in the roof system to bear the stresses and relieve the skylight panel which they support to a great extent from stresses. Relative movements of parts caused by roof expansion and contraction can take place without stressing the skylight panel.

DETAILED DESCRIPTION

Figure 1:
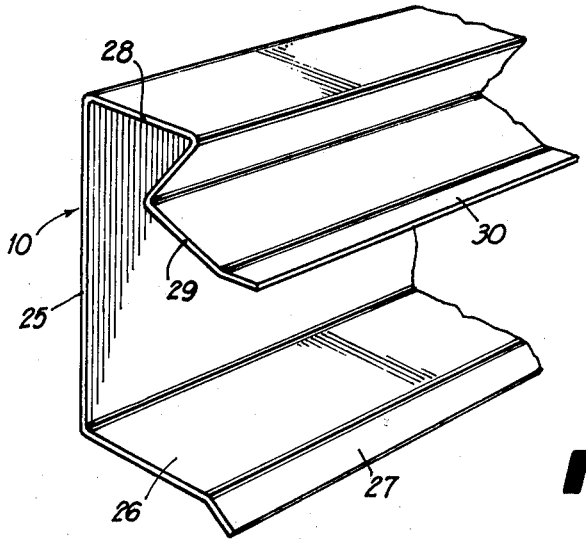
FIG. 1 is a fragmentary perspective view of a channel suspension member for a skylight panel embodied in the invention.
Figure 5:
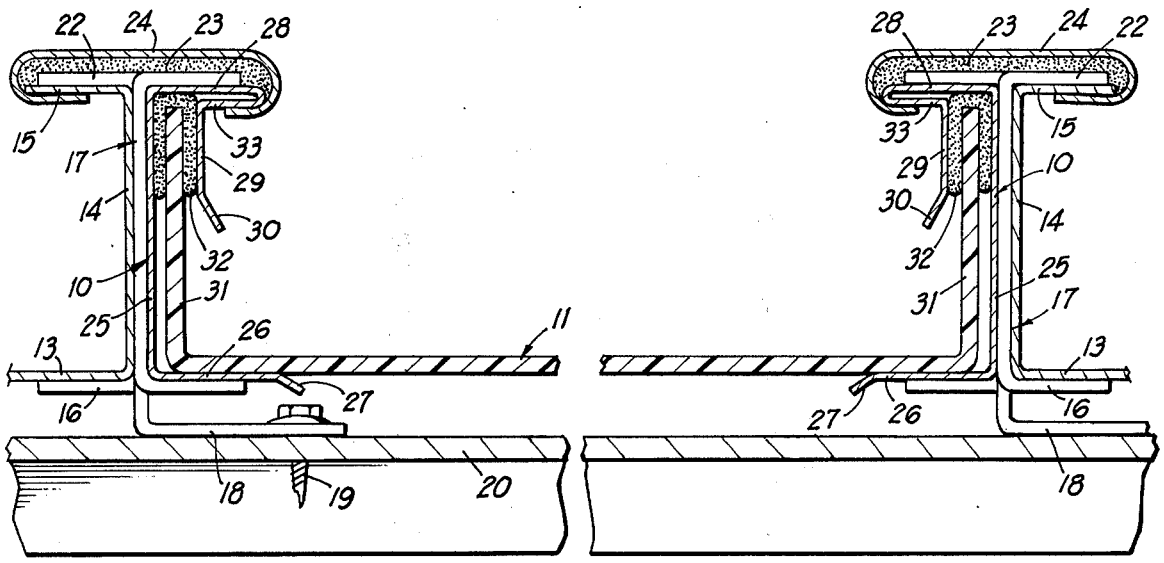
FIG. 5 is an enlarged fragmentary vertical section through a standing rib roof equipped with the skylight embodying the invention.
Figure 6:
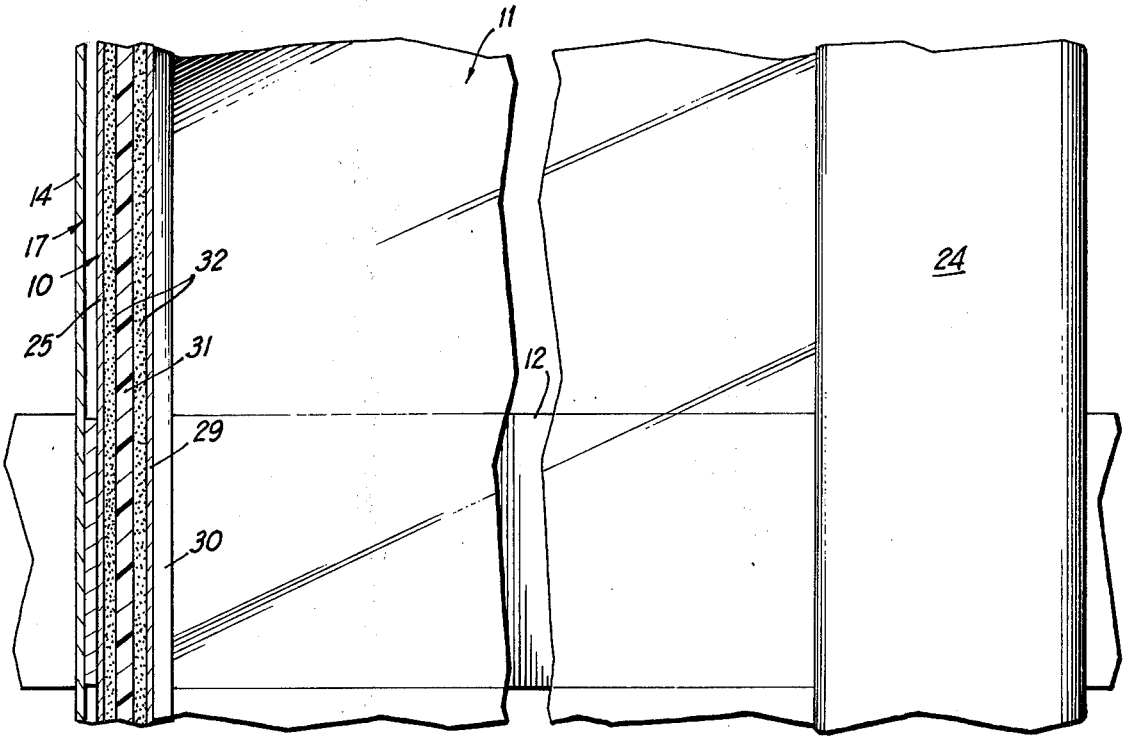
FIG. 6 is a fragmentary plan view of the roof.

Referring to the drawings in detail, wherein like numerals designate like parts, the numeral 10 in FIG. 1 designates one of a pair of sheet metal side suspension channels employed to support a skylight panel 11 of fiberglass or other suitable translucent material in a standing rib roof system of the kind depicted in FIGS. 5 and 6.

Such roof comprises appropriately spaced purlins 12, customarily formed of sheet metal in a modified Z cross section. Any required number of sheet metal roof panels 13 arranged in parallel side-by-side relationship are employed in the roof and each such panel is of channel formation and includes side standing webs 14 having top inturned continuous longitudinal flanges 15. The roof panels 13 rest on support flanges 16 of roof panel attaching clips 17 having feet 18 attached by screws 19 to top flanges 20 of the purlins 12. The flanges 16 provide a stand-off space 21 between the tops of the purlins 12 and the bottoms of the roof panels 13 as shown.

The upper flanges 15 of the roof panels engage under lateral hold-down or locator flanges 22 on the attaching clip 17 at the tops thereof and strips of sealing material 23 are intervened between the flanges 22 of the clips and the customary cap strips 24 which are closed under the flanges 15 of the roof panels, as shown in FIG. 5. The construction thus far described is prior art.

To provide an integrated skylight in the above standing T-rib roof, one of the metal roof panels 13 is omitted from the system and is replaced by the skylight panel 11 having the same width and roughly the same height dimensions, FIG. 5. The skylight panel 11 may, if desired, be coextensive lengthwise with the metal roof panels 13 and thereby extend for the entire length of the roof. In other instances, the skylight panel may be foreshortened to suit particular needs. In some roofs, more than one skylight panel 11 may be employed at appropriate laterally spaced intervals in the roof system.

Referring to FIG. 1, each skylight panel side suspension or support chanel 10 is formed preferably of the same metal employed for the roof panels 13 and comprises a vertical web 25, a right angular base flange 26, and an integral down-turned inclined base flange guard 27, whose purpose will be described. The channel 10 further comprises a top right angular flange 28, an upper depending leg 29 of right angular formation, and an attached upper leg flange guard 30, whose function will be described. In FIG. 1, the angular upper leg 29 is shown in its initial open position prior to application to one upstanding web or side wall 31 of the fiberglass skylight panel 11.

Figure 2:
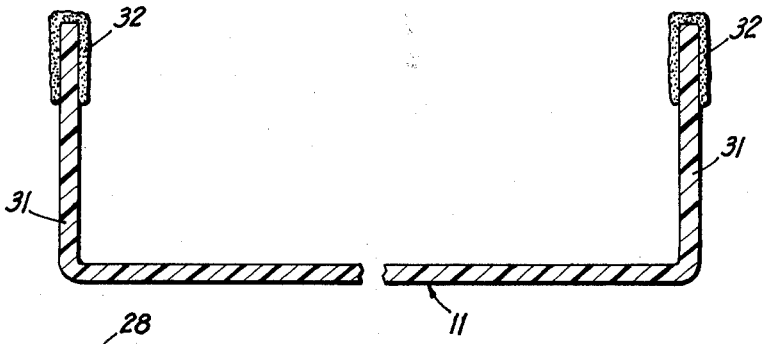
FIG. 2 is a transverse cross section through a skylight panel and sealant material.
Figure 3:
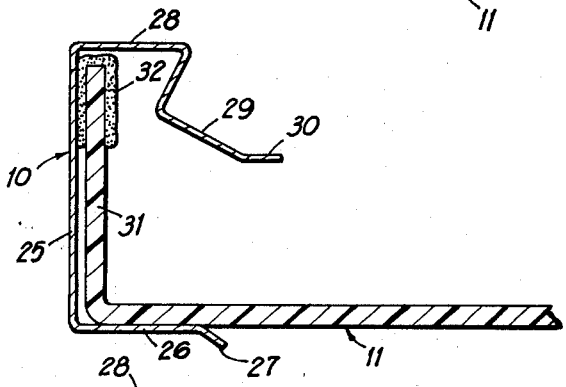
FIG. 3 is a similar section showing the initial placement of open suspension channels on the skylight panel.

Referring to FIG. 2, a pair of continuous mastic strips 32 or strips of other sealant material are formed about the top longitudinal edges of the webs 31. Following this operation, FIG. 3, a pair of the metal suspension channels 10 are applied loosely over the side webs 31 of the skylight panel 11 with the upper legs 29 still in the open positions.

Figure 4:
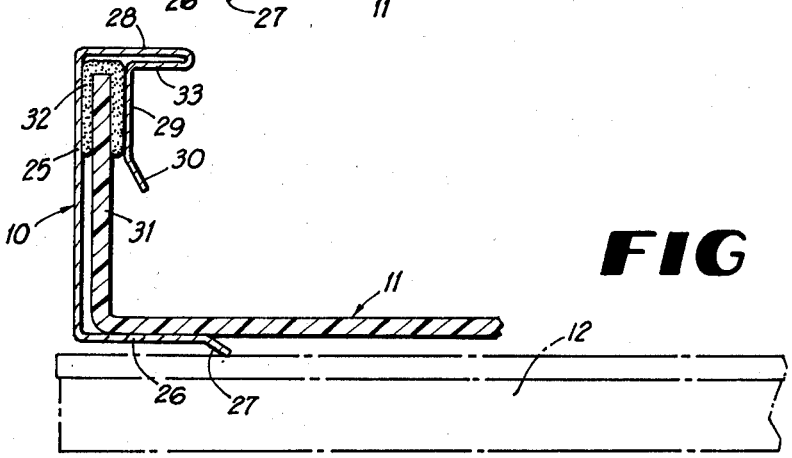
FIG. 4 is a similar view showing a suspension channel in fully closed engagement of the skylight panel.

Next, as shown in FIG. 4, the open legs 29 of the two channels 10 are closed outwardly toward the adjacent upstanding webs 31 so as to clampingly engage these webs and the adjacent sealant strip 32 between the now vertical legs 29 and the webs 25 of channels 10. The flange guard 30 now assumes the inclined position shown in FIG. 4 and stands as a bumper element to prevent contact of the skylight panel with metal components and to eliminate metal edge contact between the skylight panel and the suspension channels 10. The base flange guard 27 is for the same purpose, and in cases where no large stand-off space is provided between the underlying purlins 12 and the roof panels 13, the guard 27 serves the additonal purpose of spacing the bottom of the panel 11 from the purlins 12 to eliminate scoring and abrasion. With the channels 10 closed on the webs 31 as in FIG. 4, the horizontal flange 28 and the portion portions 33 of the leg 29 are configured to receive the closed portions of the roof cap strips 24, as shown in FIG. 5.

Referring to FIG. 5, it may now be seen that the translucent skylight panel 11 with its two metal suspension channels 10 applied thereto in the above-described manner can be received as a unit between and on the two adjacent clips 17 instead of another metal roof panel 13. The provision of the skylight panel requires no changing of the basic metal roof components and thus the use of the skylight panel is convenient and does not significantly increase the labor cost of constructing the roof with a skylight.

More importantly, as already noted, the described arrangement of the skylight panel 11 with its two metal channel attachments 10 entirely eliminates riveting the fiberglass or plastic panel or forming holes therein. This therefore increases the vapor barrier benefits of the roof system. The skylight panel 11 is somewhat floatingly held in and between the two suspension panels 11 and during roof expansion and contraction the inevitable movements of parts can take place without overstressing the skylight panel. The panel can move somewhat within and relative to the metal channels 10 while the latter, rather than the non-metallic panel, bear the brunt of the stress forces.

The numerous advantages of the invention over the customary prior art should now be apparent without the necessity for further description herein.

It is to be understood that the form of the invention herewith shown and described is to be taken as a preferred example of the same, and that various changes in the shape, size and arrangment of parts may be resorted to, without departing from the spirit of the invention or scope of the subjoined claims.

We claim:

1. In a standing rib metal roof having multiple side-by-side metal roof panels and intervening roof panel support clips for attaching the roof panels to purlins and cap strips for locking the opposing side walls of adjacent roof panels to said intervening clips, the improvement which comprises a skylight panel disposed between one pair of said clips in the space normally occupied by a metal roof panel, and a pair of side metal suspension channels mounted on opposite side walls of the skylight panel and floatingly supporting the skylight panel for restricted movements relative to said suspension channels and other components of the standing rib roof, and said side metal suspension channels configured for engagement with said support clips and said cap strips in substantially the same manner that the metal roof panels of the standing rib roof are engaged with said clips.

2. In a standing rib metal roof as defined in claim 1, and said skylight panel and said roof panels being of channel formation and sealant strips applied over the upper edges of the side web of said skylight panel and being intervened with opposite faces of said side webs and opposing portions of said metal suspension channels.

3. In a standing rib metal roof as defined in claim 2, and each of said side metal suspension channels including a bottom web engaging beneath the bottom wall of the skylight panel along one longitudinal edge portion thereof and further including a top web engageable below a locator flange on the top of each clip, and an upper right angular leg extension dependent from said top web and lying on the interior side of one side web of the skylight panel to snugly engage such side web and the adjacent sealant strip between said leg extension and the main vertical web of said metal suspension channel.

4. In a standing rib metal roof as defined in claim 3, and flange guard extensions on the bottom web and leg extension of said suspension channel in diverging relationship with the walls of the skylight panel to prevent metal edge contact with said walls.

5. In a standing rib metal roof as defined in claim 4, and said skylight panel being formed of translucent plastics.

6. In a standing rib metal roof as defined in claim 5, and said skylight panel being a fiberglass panel.

7. A skylight panel unit for placement in a standing rib metal roof in the space usually occupied by one metal roof panel between adjacent roof panel attaching clips, said skylight panel unit comprising a channel cross section skylight panel including side webs and a bottom web, and a pair of opposing side suspension metal channels for said skylight panel adapted to support the same floatingly on and between a pair of attaching clips of the standing rib metal roof, and said side suspension metal channels configured for engagement with said clips in the same manner that the metal roof panels engage the clips in said standing rib metal roof.

8. A skylight panel unit as defined in claim 7, and sealant strips disposed about the top longitudinal edges of the side webs of said skylight panel and intervened with the side webs and formed portions of said side suspension metal channels.

9. A skylight panel unit as defined in claim 8, and said formed portions consisting of top lateral extensions on said suspension channels and dependent right angle leg extensions on said lateral extensions and lying inwardly of said side webs of the skylight panel.

10. A skylight panel unit as defined in claim 7, and said skylight panel formed of translucent plastics.

* * * * *